US008899156B1

(12) United States Patent
Tseng

(10) Patent No.: US 8,899,156 B1
(45) Date of Patent: Dec. 2, 2014

(54) STUN GRENADE WITH TIME DELAY

(71) Applicant: STARJET Technologies Co., Ltd, Jintan, Jiangsu (CN)

(72) Inventor: Jui-Fu Tseng, Yilan (TW)

(73) Assignee: STARJET Technologies Co., Ltd, Jintan (CN)

( * ) Notice: Subject to any disclaimer, the term of this patent is extended or adjusted under 35 U.S.C. 154(b) by 0 days.

(21) Appl. No.: 14/108,341

(22) Filed: Dec. 17, 2013

(51) Int. Cl.
*F42B 27/00* (2006.01)

(52) U.S. Cl.
CPC ..... *F42B 27/00* (2013.01)
USPC ..... 102/482; 102/368

(58) Field of Classification Search
CPC ..... F42B 27/00
USPC ..... 102/482, 368, 486–487
See application file for complete search history.

(56) References Cited

U.S. PATENT DOCUMENTS 4,690,061 A * 9/1987 Armer et al. ..... 102/401
4,944,521 A * 7/1990 Greeno ..... 473/577
5,018,449 A * 5/1991 Eidson, II ..... 102/498
6,349,650 B1 * 2/2002 Brunn et al. ..... 102/368
6,871,594 B1 * 3/2005 Estrella ..... 102/498
7,338,343 B2 * 3/2008 Siu et al. ..... 446/473
7,905,179 B2 * 3/2011 Brock ..... 102/498
7,975,615 B1 * 7/2011 Apple ..... 102/512
8,117,966 B1 * 2/2012 Graber ..... 102/498
8,485,101 B2 * 7/2013 Frank ..... 102/498
2003/0209163 A1 * 11/2003 Huber et al. ..... 102/498
2007/0169658 A1 * 7/2007 Brock ..... 102/367
2008/0257193 A1 * 10/2008 Siu et al. ..... 102/498
2010/0043663 A1 * 2/2010 Grosch et al. ..... 102/487
2010/0199960 A1 * 8/2010 Chong ..... 124/57
2011/0017187 A1 * 1/2011 Brock ..... 124/71
2014/0116280 A1 * 5/2014 Berger ..... 102/368

* cited by examiner

*Primary Examiner* — Michelle R Clement

(57) ABSTRACT

A stun grenade is provided with a housing; al receptacle including a bottom hole and a hollow externally threaded member; an air canister in the receptacle; an internally threaded cap including a top opening and a top bifurcation including two opposite through holes in an intermediate portion, and two opposite first pivot holes in a rear portion; a striker unit including a striker and a spring loaded hinge pivotably fastened between the first pivot holes; a needle inserted through the hollow externally threaded member to have one end engaged with the air canister and an other end projecting out of the top opening; a lever having a front end pivotably secured to a front end of the bifurcation and including two opposite second pivot holes at an intermediate portion; and a safety pin inserted through the second pivot holes and the through holes to anchor the needle below.

2 Claims, 8 Drawing Sheets

STUN GRENADE WITH TIME DELAY

BACKGROUND OF THE INVENTION

1. Field of the Invention

The invention relates to stun grenades and more particularly to a stun grenade having a time delay mechanism.

2. Description of Related Art

A conventional stun grenade comprises a housing having a tubular body with end members brazed to the ends of the tubular body, and a collar member threadedly received in a threaded central opening in one end member for supporting an explosive charge in the housing. At the inner end of the collar member is a cylinder to which a tubular container filled with explosive charge is attached. Outer diameter of the tubular container is less than a minimum diameter of the threaded opening in the one end member to permit the tubular container to be inserted through the threaded opening while attached to the collar member. At the outer end of the collar member is a threaded recess for receipt of a fuse member externally of the housing. A flash hole in the collar member directs a flash which is produced when the fuse member is activated into the tubular container to ignite the explosive charge.

While it has some utility, improvements in these products are desired, and these improvements are provided by the invention.

SUMMARY OF THE INVENTION

It is therefore one object of the invention to provide a stun grenade comprising a housing comprising an externally threaded extension on a top; a cylindrical receptacle comprising internal threads on a top, a bottom hole, and a hollow externally threaded member secured to the internal threads; an air canister disposed in the receptacle; an internally threaded cap threadedly secured to both the externally threaded extension and the hollow externally threaded member, the internally threaded cap comprising a top opening, and a bifurcation disposed on a top of the internally threaded cap, the bifurcation including two opposite through holes in an intermediate portion, two opposite first pivot holes in a rear portion, and two second pivot holes between the through holes and the first pivot holes; a striker unit comprising a striker and a spring loaded hinge pivotably fastened between the second pivot holes; a needle inserted through the hollow externally threaded member to have one end engaged with the air canister and an other end projecting out of the top opening; a lever having a front end pivotably secured to a front end of the bifurcation and comprising two opposite third pivot holes at an intermediate portion; and a safety pin inserted through the third pivot holes and the through holes to anchor the needle below; wherein in response to a removal of the safety pin, the lever is unlocked to turn the spring loaded hinge so that the striker hits and pushes down the needle which punctures the air canister to release compressed air from the air canister into the receptacle, the compressed air flows out of the receptacle into the housing via the bottom hole, the pressure in the housing increases constantly, and the housing explodes when the pressure reaches a predetermined value.

The above and other objects, features and advantages of the invention will become apparent from the following detailed description taken with the accompanying drawings.

DETAILED DESCRIPTION OF THE INVENTION

Figure 1:
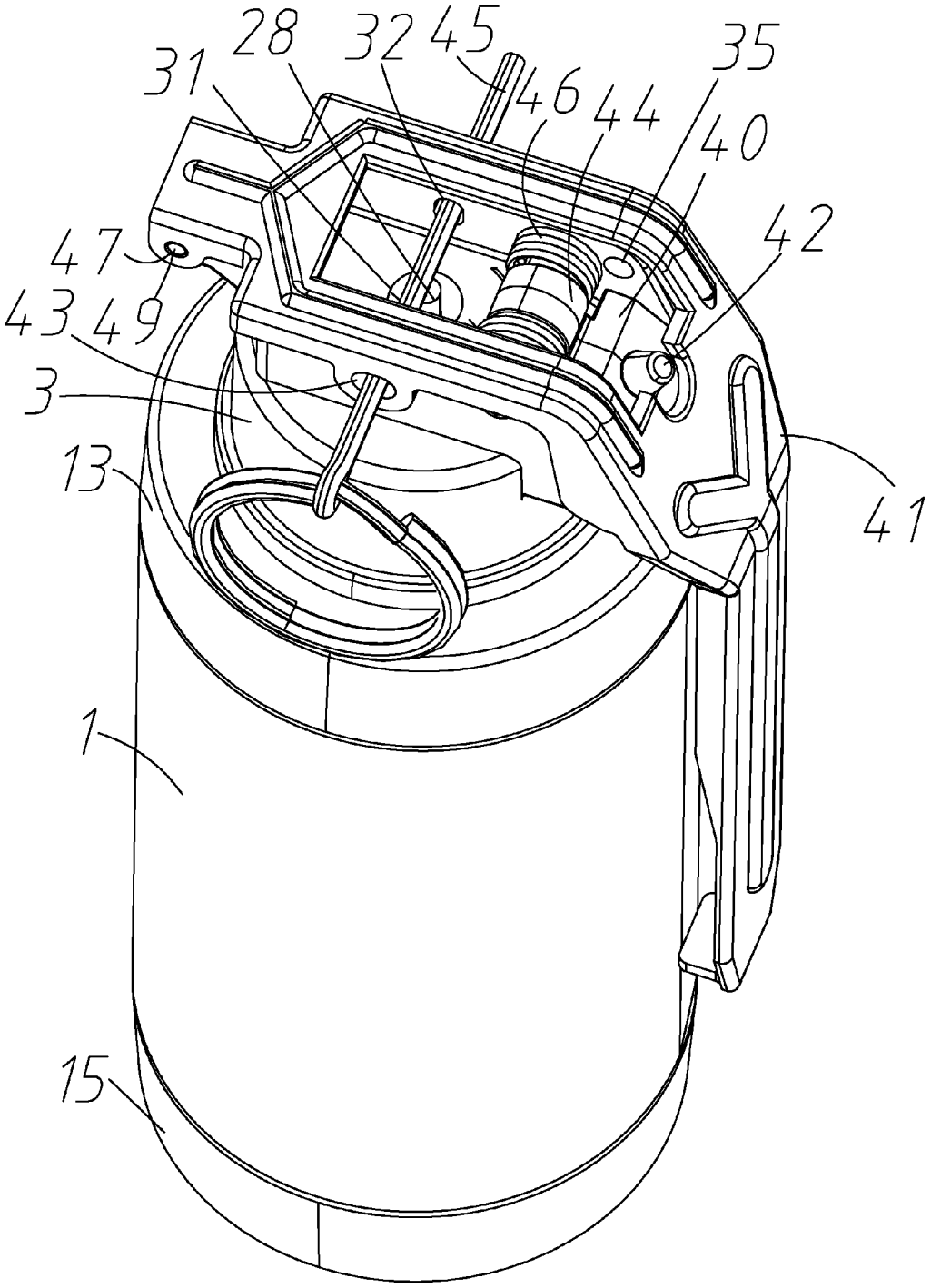
FIG. 1 is a perspective view of a stun grenade according to a first preferred embodiment of the invention.
Figure 2:
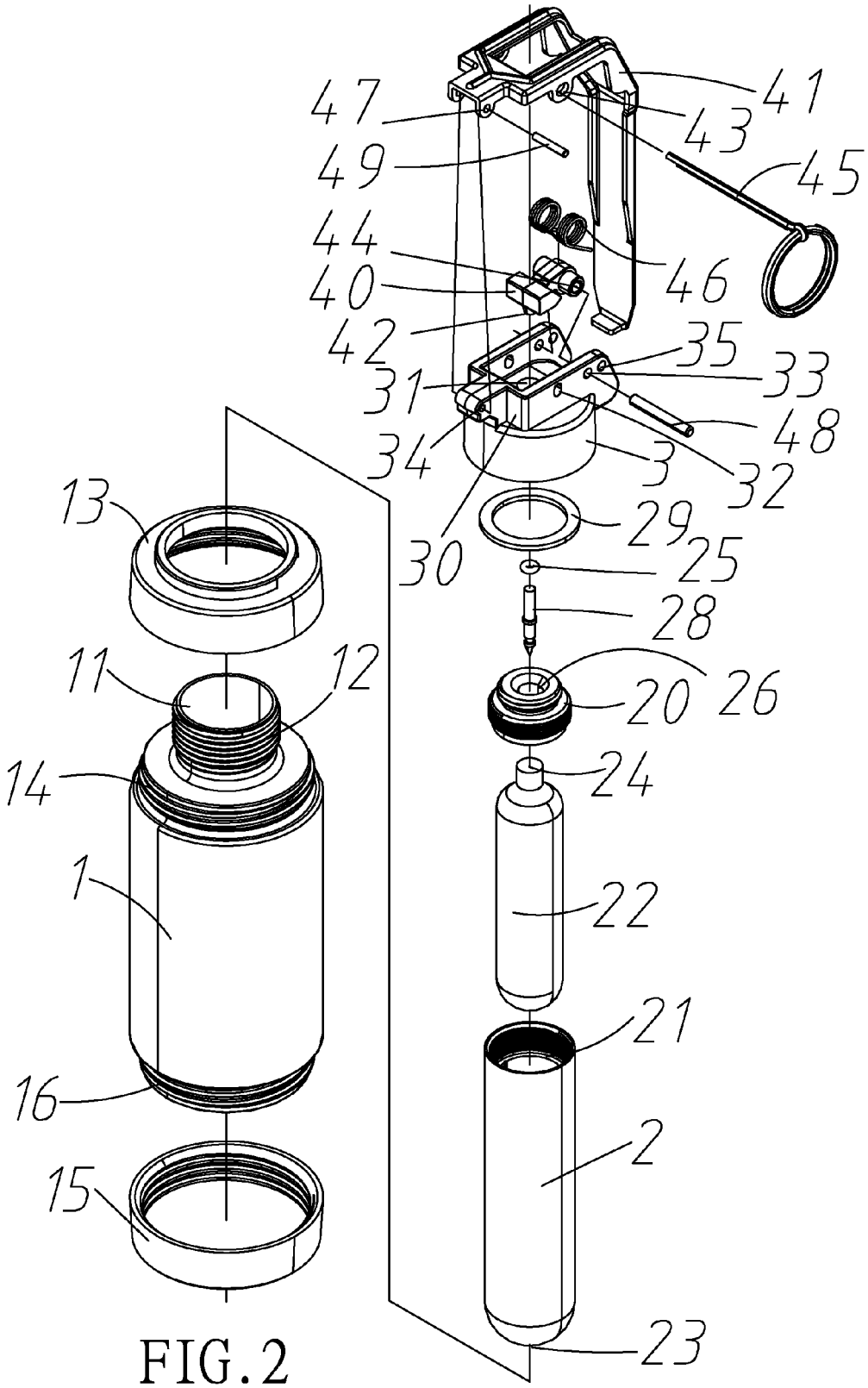
FIG. 2 is an exploded view of the stun grenade of FIG. 1.

Referring to FIGS. 1 to 5, a stun grenade in accordance with a first preferred embodiment of the invention comprises the following components as discussed in detail below.

A cylindrical housing 1 comprises an externally threaded neck 14 at a top end, an externally threaded extension 12 projecting outwardly out of a central portion of the neck 14, an opening 11 through the extension 12, an internally threaded ring 13 secured to the neck 14, an externally threaded extension 16 at a bottom end, and an internally threaded base 15 secured to the extension 16.

A cylindrical receptacle 2 comprises internal threads 21 on a top, a hole 23 at a center of an ogive-shaped bottom, an externally threaded member 20 secured to the internal threads 21 and including a passage 26 through its length. A cylindrical air canister 22 is disposed in the receptacle 2 and comprises a top 24.

An internally threaded cap 3 is secured to both the extension 12 and the externally threaded member 20. The cap 3 comprises a through hole 31 on a top, and a bifurcation 30 provided on top of the cap 3 and including a first pivot hole 34 at a front end, two opposite through holes 32 in an intermediate portion, two opposite second pivot holes 35 in the rear, and two third pivot holes 33 between the through holes 32 and the second pivot holes 35.

A striker unit 40 comprises a striker 42, a barrel 44, a torsion spring 46 put on the barrel 44 and urging against the top of the cap 3 and the barrel 44 respectively (i.e., being functioned as a spring loaded hinge), and a first pin 48 driven through the second pivot holes 33 and the barrel 44. A needle 28 is inserted through the passage 26 to have its pointed end engaged with the top 24 of the air canister 22 and a top projecting out of the through hole 31. An O-ring 25 is provided in the passage 26 to sealingly anchor the needle 28. A sealing ring 29 is also provided on top of the externally threaded member 20.

A lever 4 comprises two opposite third pivot holes 47 at a front end, two opposite fourth pivot holes 43 at an intermediate portion, a second pin 49 driven through the third pivot holes 47 and the first pivot hole 34 to pivotably secure the striker unit 40 and the bifurcation 30 (i.e., the cap 3) together, and a safety pin 45 inserted through the fourth pivot holes 43 and the through holes 32 to hold the needle 28 in place below.

Figure 3:
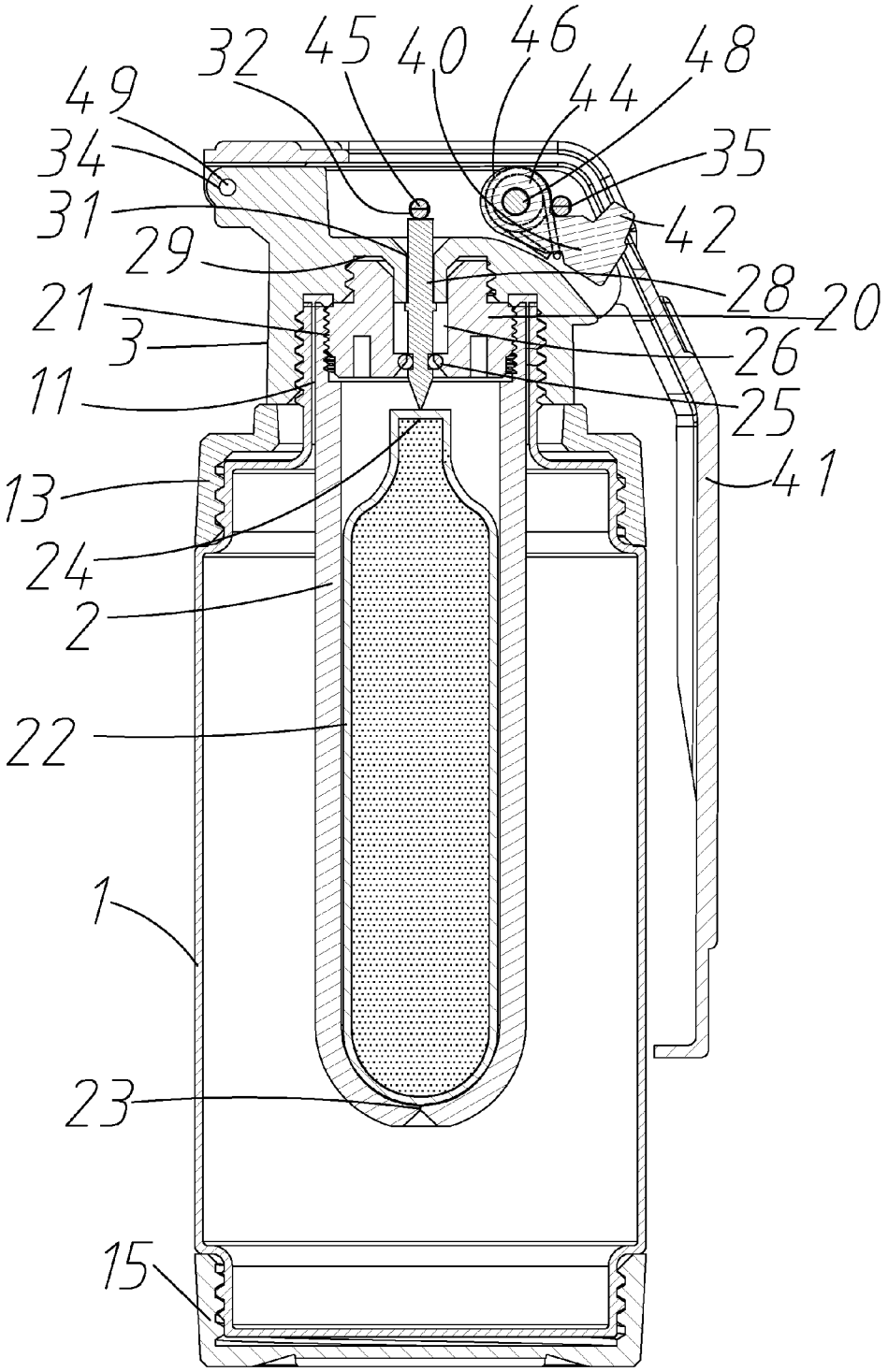
FIG. 3 is a longitudinal section through the stun grenade of FIG. 1.
Figure 4:
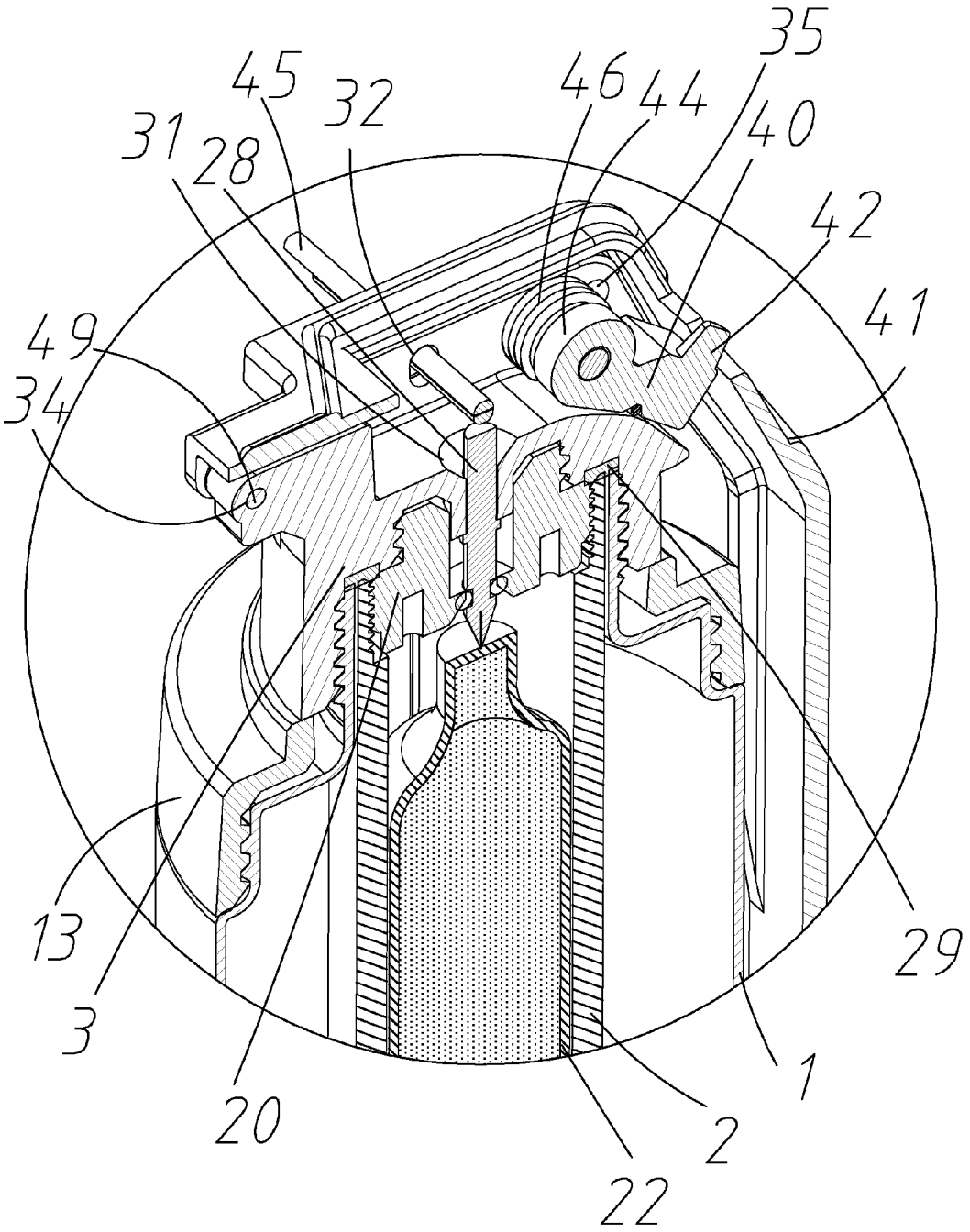
FIG. 4 is an enlarged view of an upper portion of FIG. 3.
Figure 5:
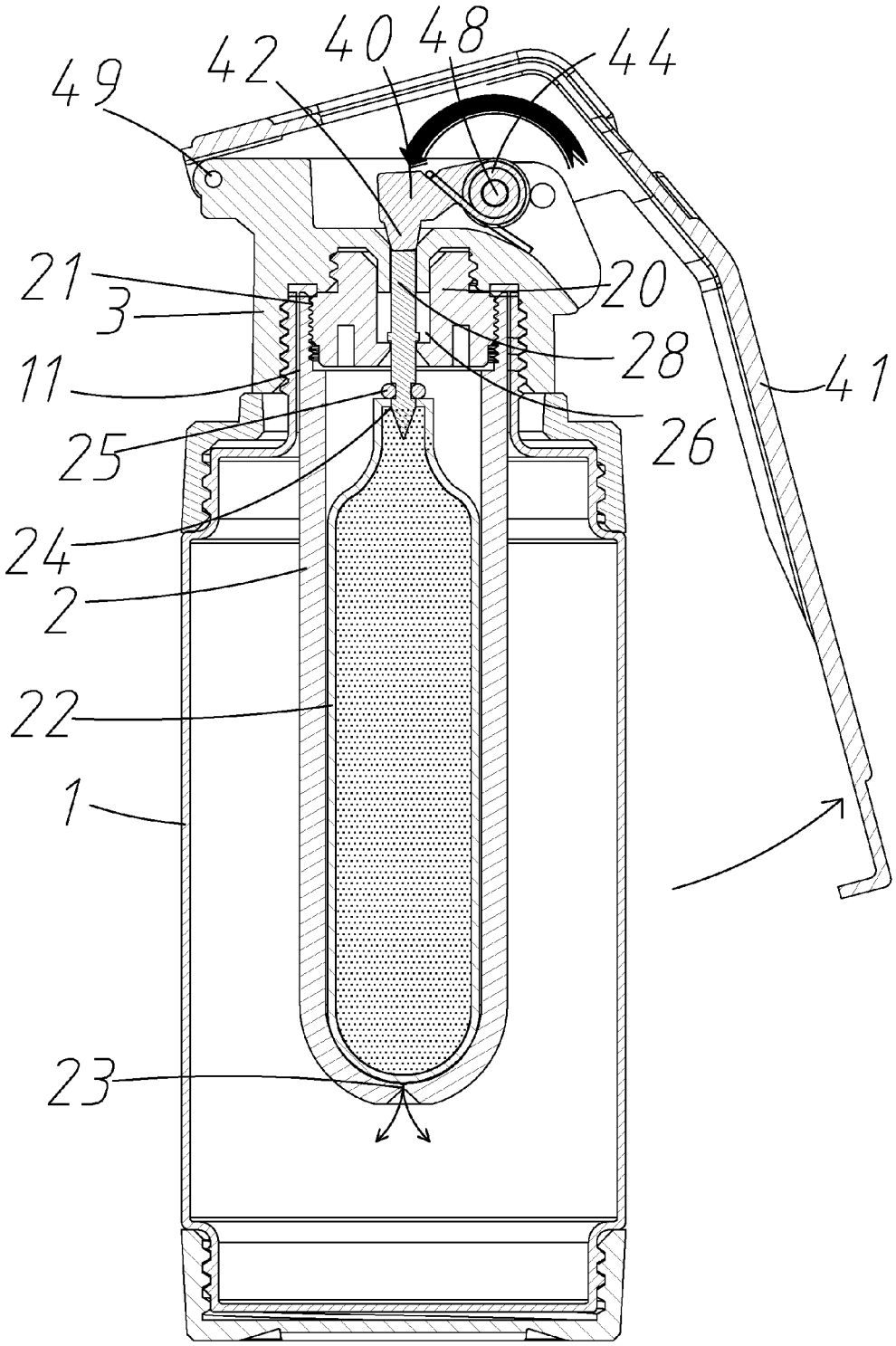
FIG. 5 is a view similar to FIG. 3 showing the firing mechanism being triggered.

Following are steps of operating the stun grenade: As shown in FIGS. 3 to 5, a user may remove the safety pin 45 to unlock the lever 41. The restraint imposed on the spring 46 by the lever 41 is lifted. Thus, the energized spring 46 (i.e., the striker unit 40) counterclockwise turns about 180-degree to cause the striker 42 to hit and push down the needle 28 in order to move the pointed end of the needle 28 downward to pierce the top 24 into the air canister 22. Compressed air is next released from the air canister 22 and flows out of the receptacle 2 into the housing 1 via the opening 23. Pressure in the housing 1 builds constantly. The housing 1 may be filled with, for example, riot control agent composition. The housing 1 may explode after the pressure reaches a predetermined value (i.e., having the effect of time delay).

Figure 6:
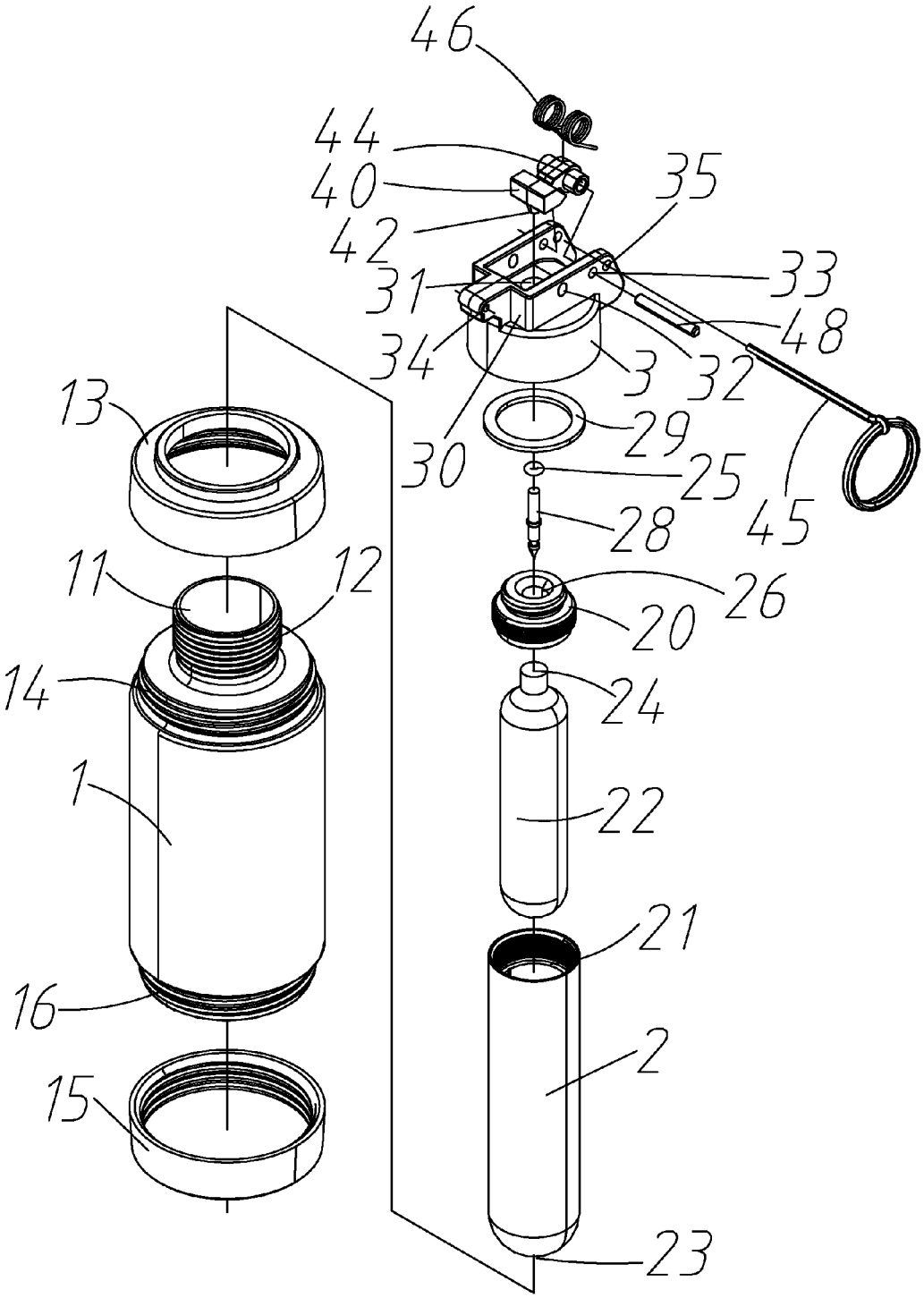
FIG. 6 is an exploded view of a stun grenade according to a second preferred embodiment of the invention.
Figure 7:
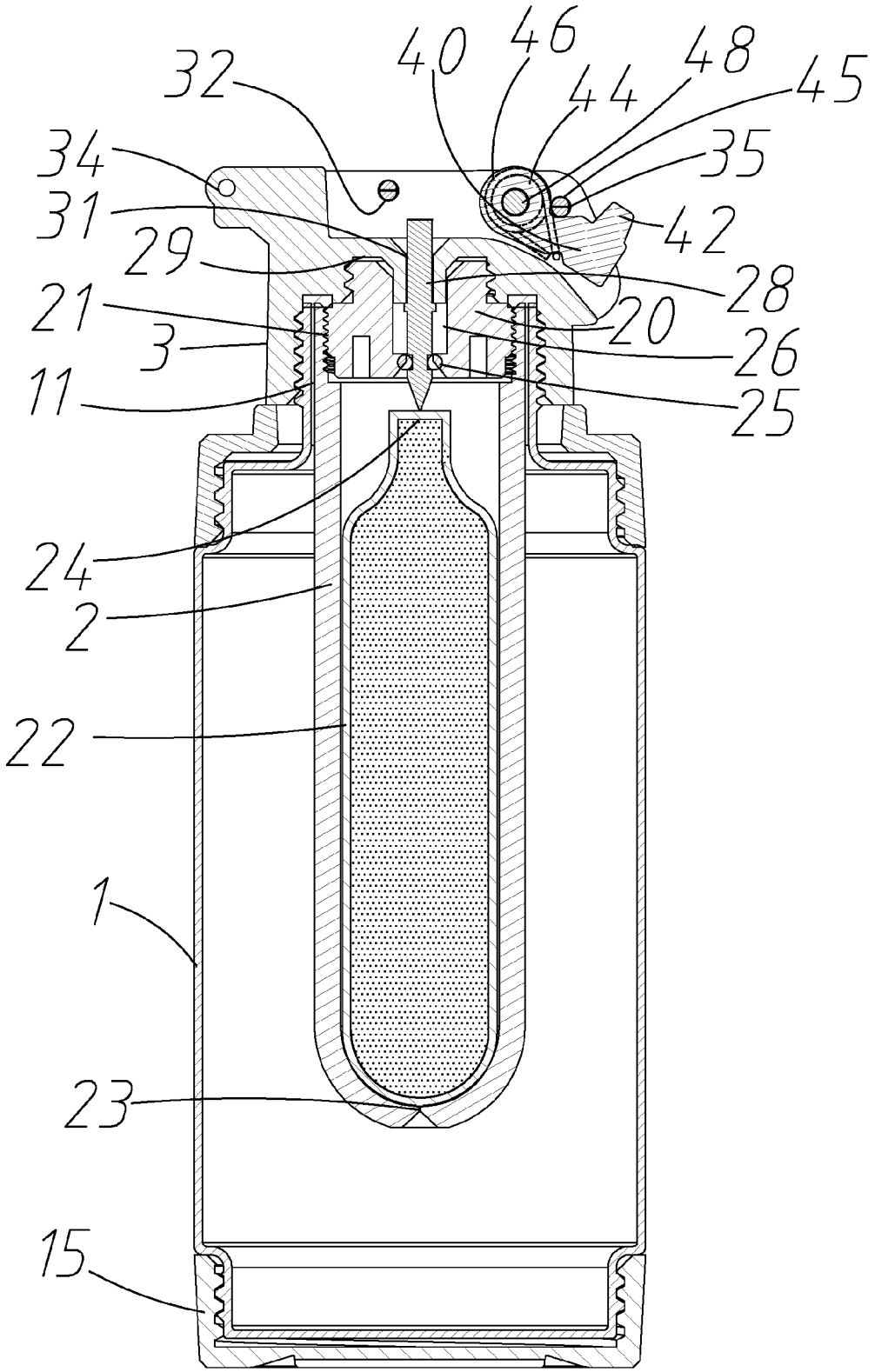
FIG. 7 is a longitudinal section through the assembled stun grenade of FIG. 6.
Figure 8:
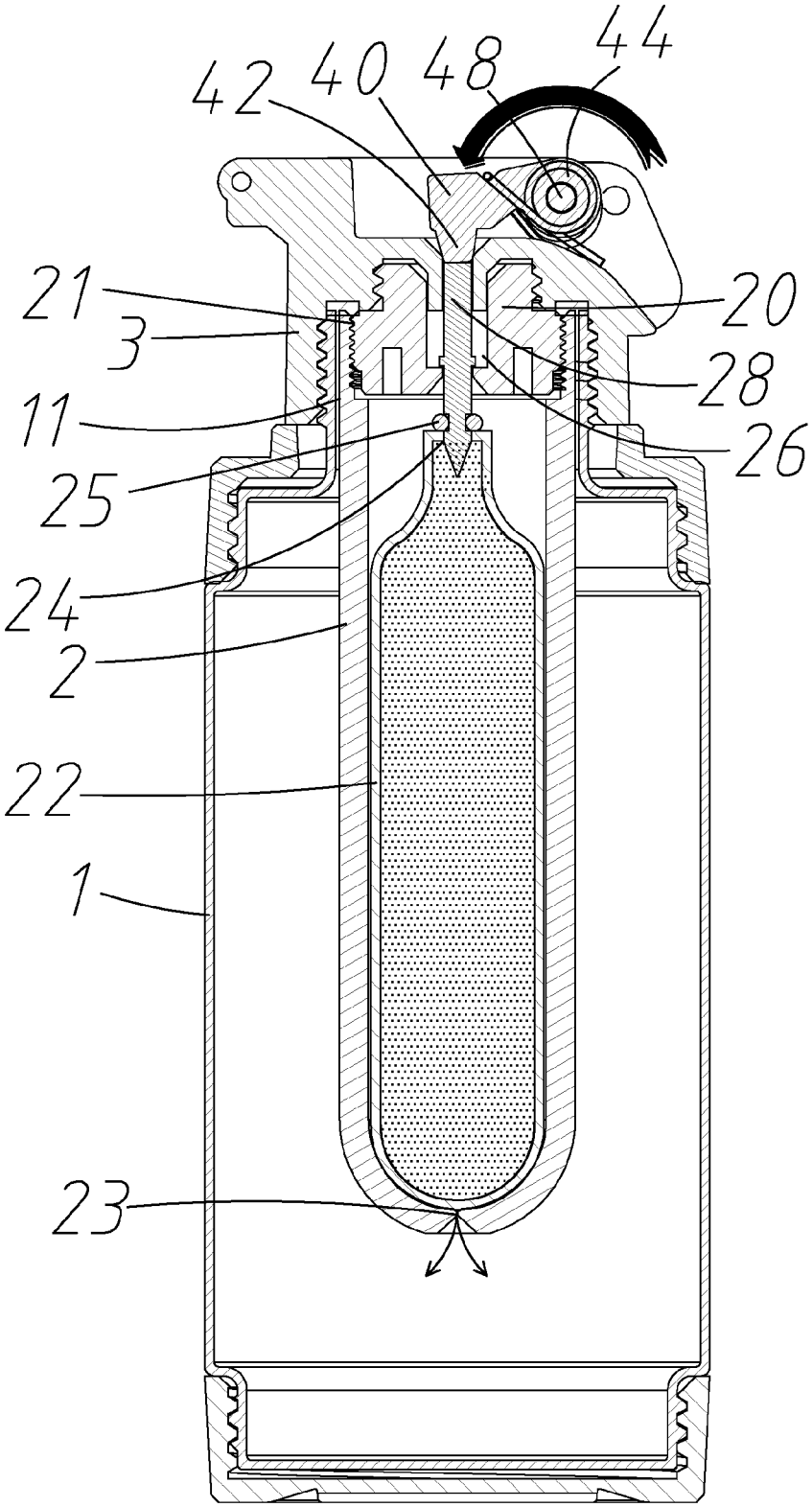
FIG. 8 is a view similar to FIG. 7 showing the firing mechanism being triggered.

Referring to FIGS. 6 to 8, a stun grenade in accordance with a second preferred embodiment of the invention is shown. The characteristics of the second preferred embodiment are substantially the same as that of the first preferred embodiment except the following: The lever is removed. The safety pin 45 is inserted through the second pivot holes 35 hold the barrel 44 in place below.

Following are steps of operating the stun grenade: As shown in FIGS. 7 and 8, a user may remove the safety pin 45 to lift the restraint imposed on the spring 46. Thus, the energized spring 46 (i.e., the striker unit 40) counterclockwise turns about 180-degree to cause the striker 42 to hit and push down the needle 28 in order to move the pointed end of the needle 28 downward to pierce the top 24 into the air canister 22. Compressed air is next released from the air canister 22 and flows out of the receptacle 2 into the housing 1 via the opening 23. Pressure in the housing 1 builds constantly. The housing 1 may be filled with, for example, riot control agent composition. The housing 1 may explode after the pressure reaches a predetermined value (i.e., having the effect of time delay).

While the invention has been described in terms of preferred embodiments, those skilled in the art will recognize that the invention can be practiced with modifications within the spirit and scope of the appended claims.

What is claimed is:

1. A stun grenade comprising:

a housing comprising an externally threaded extension on a top;

a cylindrical receptacle comprising internal threads on a top, a bottom hole, and a hollow externally threaded member secured to the internal threads;

an air canister disposed in the receptacle;

an internally threaded cap threadedly secured to both the externally threaded extension and the hollow externally threaded member, the internally threaded cap comprising a top opening, and a bifurcation disposed on a top of the internally threaded cap, the bifurcation including two opposite through holes in an intermediate portion, and two opposite first pivot holes in a rear portion;

a striker unit comprising a striker and a spring loaded hinge pivotably fastened between the first pivot holes;

a needle inserted through the hollow externally threaded member to have one end engaged with the air canister and an other end projecting out of the top opening;

a lever having a front end pivotably secured to a front end of the bifurcation and comprising two opposite second pivot holes at an intermediate portion; and a safety pin inserted through the second pivot holes and the through holes to anchor the needle below;

wherein in response to a removal of the safety pin, the lever is unlocked to turn the spring loaded hinge so that the striker hits and pushes down the needle which punctures the air canister to release compressed air from the air canister into the receptacle, the compressed air flows out of the receptacle into the housing via the bottom hole, the pressure in the housing increases constantly, and the housing explodes when the pressure reaches a predetermined value.

2. A stun grenade comprising:

a housing comprising an externally threaded extension on a top;

a cylindrical receptacle comprising internal threads on a top, a bottom hole, and a hollow externally threaded member secured to the internal threads;

an air canister disposed in the receptacle;

an internally threaded cap threadedly secured to both the externally threaded extension and the hollow externally threaded member, the internally threaded cap comprising a top opening, and a bifurcation disposed on a top of the internally threaded cap, the bifurcation including two opposite first pivot holes in a rear portion, and two opposite second pivot holes forwardly of the first pivot holes;

a striker unit comprising a striker and a spring loaded hinge pivotably fastened between the second pivot holes;

a needle inserted through the hollow externally threaded member to have one end engaged with the air canister and an other end projecting out of the top opening; and a safety pin inserted through the first pivot holes to anchor the needle below;

wherein in response to a removal of the safety pin, the lever is unlocked to turn the spring loaded hinge so that the striker hits and pushes down the needle which punctures the air canister to release compressed air from the air canister, the compressed air enters the receptacle, the compressed air flows out of the receptacle into the housing via the bottom hole, pressure in the housing increases constantly, and the housing explodes when the pressure reaches a predetermined value.

* * * * *